US007448917B2

(12) United States Patent
Liao et al.

(10) Patent No.: US 7,448,917 B2
(45) Date of Patent: Nov. 11, 2008

(54) CONNECTOR HAVING PIN GROUPS WITH DIFFERENT PIN LENGTHS

(75) Inventors: Yu-Jing Liao, Tao Yuan (TW); Yao-Chung Lin, Tao Yuan (TW); Yi-Tsung Cheng, Tao Yuan (TW); Wei-Chih Chang, Tao Yuan (TW); Yu-Chun Peng, Tao Yuan (TW); Cheng-Hsi Liu, Tao Yuan (TW)

(73) Assignee: HTC Corporation, Taoyuan County (TW)

( * ) Notice: Subject to any disclaimer, the term of this patent is extended or adjusted under 35 U.S.C. 154(b) by 0 days.

(21) Appl. No.: 11/621,569

(22) Filed: Jan. 10, 2007

(65) Prior Publication Data

US 2007/0218725 A1 Sep. 20, 2007

(30) Foreign Application Priority Data

Mar. 20, 2006 (TW) ..... 95109409 A

(51) Int. Cl.
*H01R 24/00* (2006.01)

(52) U.S. Cl. ..... 439/660

(58) Field of Classification Search ..... 439/660, 439/608, 108, 609, 76.1, 79, 700, 289
See application file for complete search history.

(56) References Cited

U.S. PATENT DOCUMENTS

| | | | | |
|---|---|---|---|---|
| 5,387,114 | A * | 2/1995 | Brunker et al. | 439/108 |
| 6,347,962 | B1 * | 2/2002 | Kline | 439/608 |
| 6,843,686 | B2 * | 1/2005 | Ohnishi et al. | 439/608 |
| 6,945,824 | B1 | 9/2005 | Li et al. | |

FOREIGN PATENT DOCUMENTS

TW M267690 6/2005

* cited by examiner

*Primary Examiner*—Chandrika Prasad
(74) *Attorney, Agent, or Firm*—Jianq Chyun IP Office

(57) ABSTRACT

A connector for connecting a host and a peripheral device is disclosed. The connector includes N pin groups and each of the N pin groups has different pin length, wherein N is a positive integer and is greater than or equal to 3. The first pin group consists of ground pins and has the longest pin length.

20 Claims, 4 Drawing Sheets

CONNECTOR HAVING PIN GROUPS WITH DIFFERENT PIN LENGTHS

CROSS-REFERENCE TO RELATED APPLICATION

This application claims the priority benefit of Taiwan application serial no. 95109409, filed Mar. 20, 2006. All disclosure of the Taiwan application is incorporated herein by reference.

BACKGROUND OF THE INVENTION

1. Field of the Invention

The present invention relates to a connector. More particularly, the present invention relates to a connector having different pin lengths.

2. Description of Related Art

Universal serial bus (USB) is usually used as the interface for transmitting digital signals, and as to some commonly used peripheral devices, such as earphones and speakers, to improve audio quality and simplify design, independent connectors are generally used for transmitting data and for differentiating the peripheral devices. However, as to those hand-held devices whose designs are going towards being light, thin, short, compact and small, such as mobile phones, personal digital assistants (PDAs), smart phones, GPS devices, music players, and game machines, the cost and the volumes thereof may be increased if various connectors are to be disposed therein.

Generally, the pin lengths of a connector are the same, the angle of inserting the connector is different when the user habit and the working environment are different. Signal misjudgment may be caused if the pin connection sequence in the connector is not consistent, for example, if the pin for transmitting signal is connected before the ground pin, signal misjudgment will be caused due to a lack of ground voltage level.

SUMMARY OF THE INVENTION

Accordingly, the present invention is directed to provide a connector which is suitable for both USB and audio signal transmissions.

According to another aspect of the present invention, a connector is provided, wherein USB pins and audio signal pins are integrated into an insulating layer, so as to integrate the functions of various connectors.

According to yet another aspect of the present invention, a connector is provided, wherein pins of different lengths are disposed according to different functions so that the connector can be applied to different insertion angles, accordingly the accuracy of signal transmission is improved and signal misjudgment is avoided.

To achieve the aforementioned and other aspects, the present invention provides a connector for connecting a host and a peripheral device. The connector includes N pin groups and each of the pin groups has different pin length, wherein N is a positive integer and is greater than or equal to 3.

According to a connector in an embodiment of the present invention, if N is equal to 5, the connector includes 5 pin groups, the pin lengths of the pin groups are respectively $L_1$~$L_5$. Wherein $L_1$, $L_2$, $L_3$, $L_4$, $L_5$ are all positive integers, and $L_1>L_2>L_3>L_4>L_5$.

To achieve the aforementioned and other aspects, the present invention provides a connector for connecting a host and a peripheral device. The connector includes two ground pins, three audio pins, a power supply pin, three signal pins, and two data pins. Wherein, the length of the ground pins is $L_1$, the length of the audio pins is $L_2$, the length of the power supply pin is $L_3$, the length of the signal pins is $L_4$, and the length of the data pins is $L_5$. Wherein, $L_1$, $L_2$, $L_3$, $L_4$, $L_5$ are all positive integers and $L_1>L_2>L_3>L_4>L_5$.

To achieve the aforementioned and other aspects, the present invention provides a connector for connecting a host and a peripheral device. The connector includes an insulating layer having a top surface and a bottom surface and N pin groups respectively disposed on the top surface and the bottom surface, wherein each of the pin groups has different pin length, N is a positive integer and N is greater than or equal to 3.

According to a connector in an embodiment of the present invention, if N is equal to 5, the connector includes 5 pin groups, and the pin lengths of the 5 pin groups are respectively $L_1$~$L_5$. Wherein $L_1$, $L_2$, $L_3$, $L_4$, $L_5$ are all positive integers and $L_1>L_2>L_3>L_4>L_5$.

In overview, multiple pins are adopted in the present invention to integrate USB and audio signal transmission interfaces into a connector so that a single connector can perform more functions, accordingly, the number of connectors and the space required by the connectors in an electronic apparatus can be reduced. Meanwhile, pins of different lengths are disposed according to different functions so that the connector can be applied to different insertion angles, accordingly, the accuracy of signal transmission is increased and signal misjudgment is avoided.

In order to make the aforementioned and other aspects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
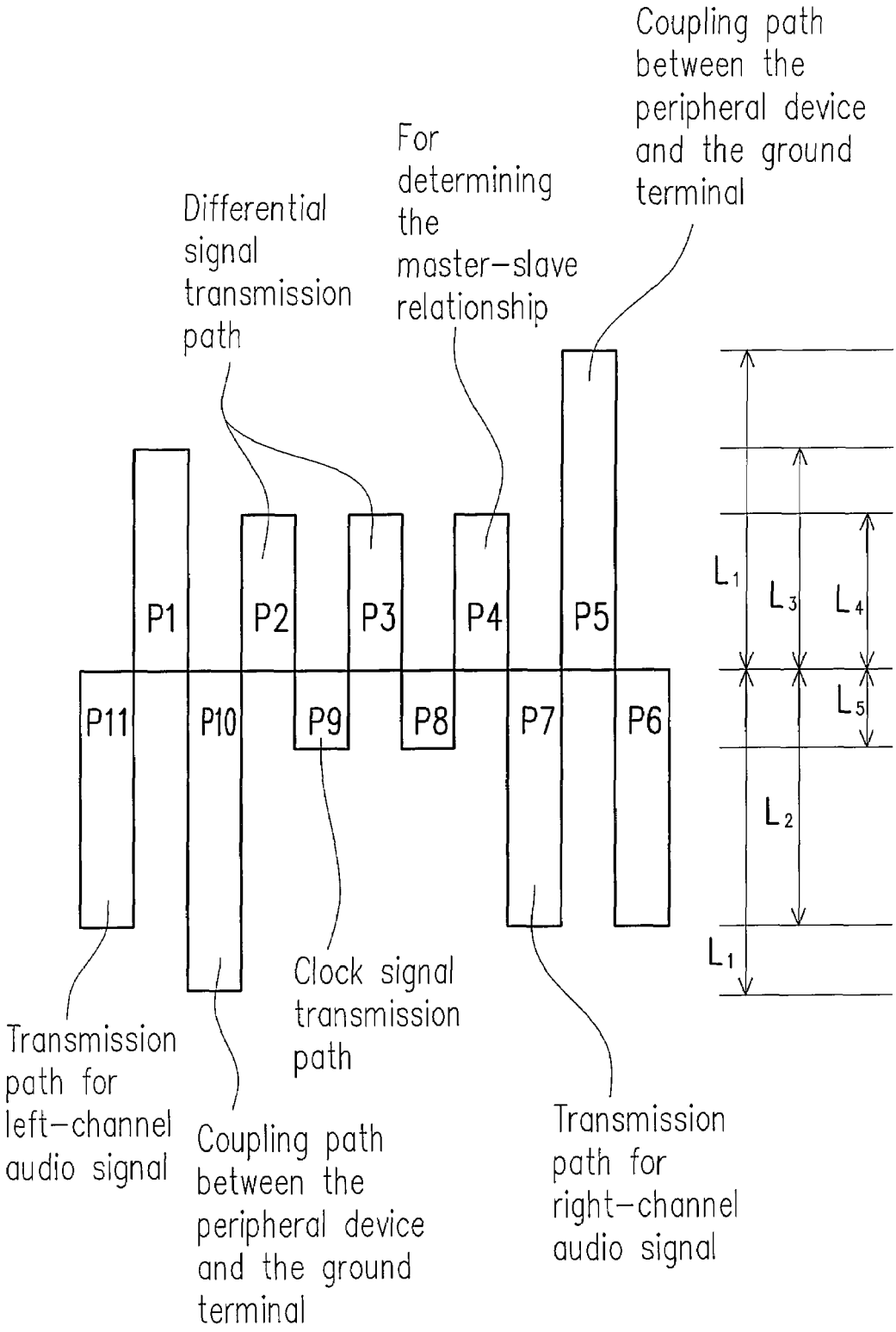
FIG. 1 is a diagram illustrating the pin lengths of a connector according to an embodiment of the present invention.

FIG. 1 is a diagram illustrating the pin lengths of a connector according to an embodiment of the present invention. In the present embodiment, the pin lengths of the connector are classified into 5, which are respectively $L_1$~$L_5$. The 11 pins P1~P11 in the present embodiment are classified into 5 pin groups based on the pin lengths $L_1$~$L_5$ thereof. The first pin group is ground pins including pins P5 and P10, which are referred to thereinafter as ground pins P5 and P10, and the pin length thereof is $L_1$. The second pin group is audio pins including pins P6, P7, and P11, which are referred to thereinafter as audio pins P6, P7, and P11, and the pin length thereof is $L_2$. The third pin group is power supply pin including only pin P1, which is referred to thereinafter as power supply pin P1, and the pin length thereof is $L_3$. The fourth pin group is signal pins including pins P2, P3, and P4, which are referred to thereinafter as signal pins P2, P3, and P4, and the pin length thereof is $L_4$. The fifth pin group is data pins including pins P8 and P9, which are referred to thereinafter as data pins P8 and P9, and the pin length thereof is $L_5$. Wherein $L_1$, $L_2$, $L_3$, $L_4$, and $L_5$ are all positive integers and $L_1>L_2>L_3>L_4>L_5$.

In the present embodiment, the pins P1~P11 are classified into 5 different lengths, wherein the pin length $L_1$ of the ground pins P5 and P10 is the longest. Thus, during normal operation, the ground pins P5 and P10 always connect the peripheral device and the host first regardless from which direction the user inserts the connector into the host, so that a common ground voltage level can be built up first between the host and the peripheral device to avoid signal misjudgment due to different user habit or working environment.

Figure 3:
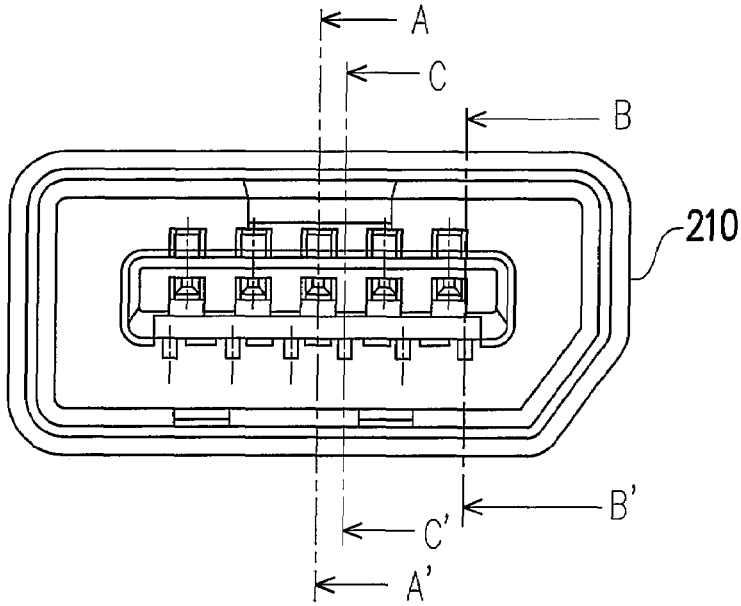
FIG. 3 is a cross-sectional view illustrating the major pins of a connector according to an embodiment of the present invention.
Figure 4A:
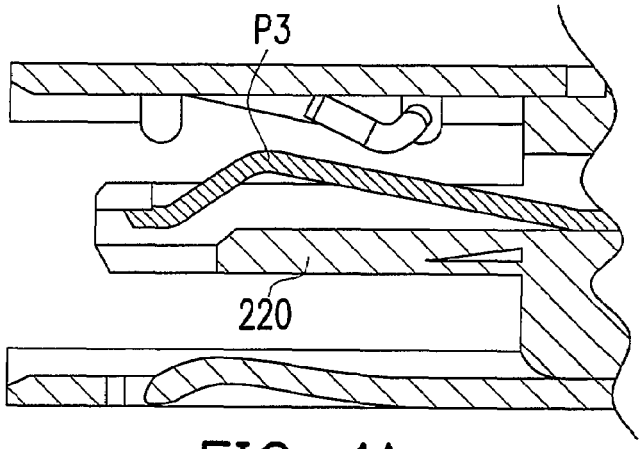
FIG. 4A is a cross-sectional view of FIG. 3 cut along line A~A'.
Figure 4B:
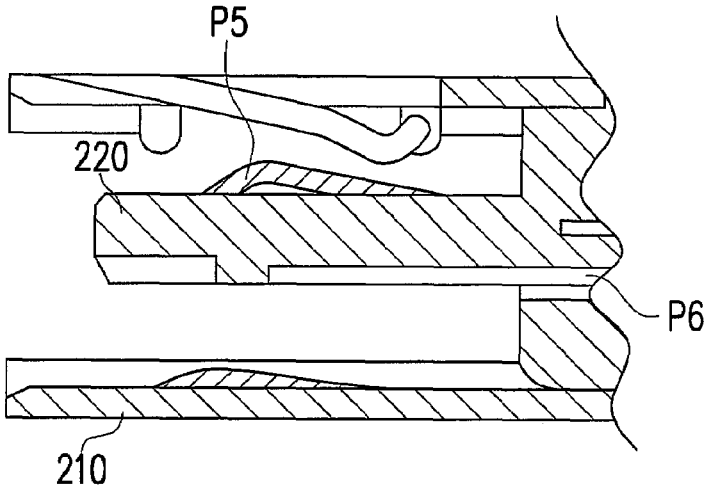
FIG. 4B is a cross-sectional view of FIG. 3 cut along line B~B'.
Figure 4C:
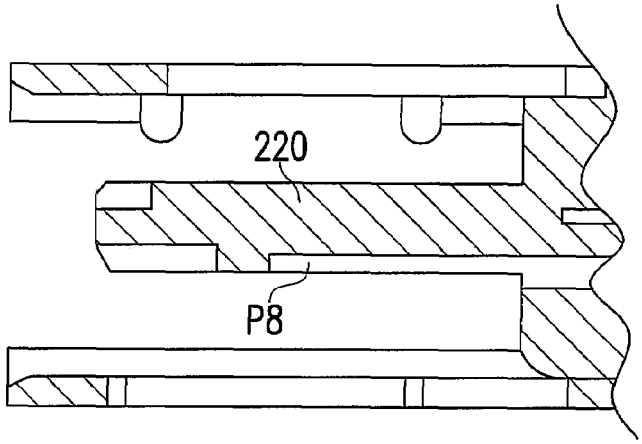
FIG. 4C is a cross-sectional view of FIG. 3 cut along line C~C'.
Figure 5:
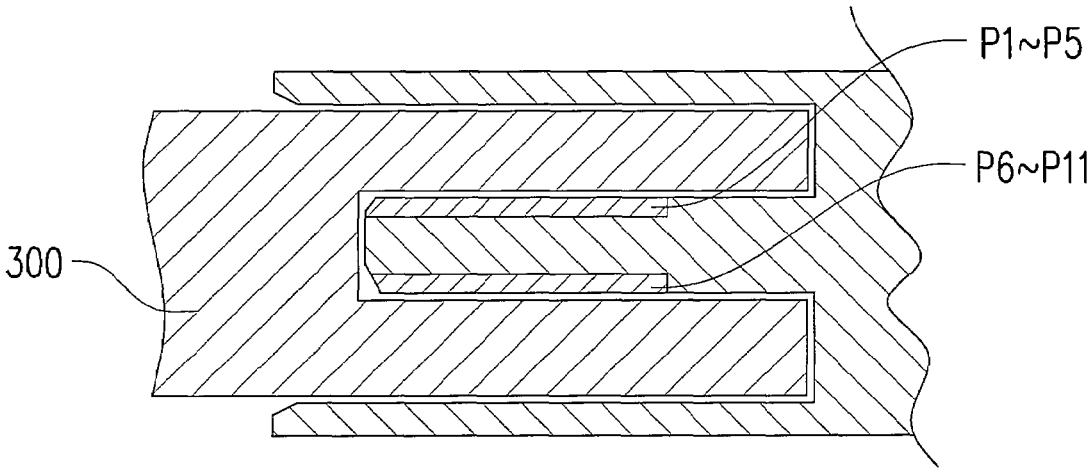

FIG. 4C is a cross-sectional view of FIG. 3 cut along line C~C', and FIG. 5 is a schematic cross-sectional view for showing the connection between the pins of FIG. 1 and a standard USB interface.

The data pins P8 and P9 are mainly used for providing a digital signal transmission path between the peripheral device and the host, and the pin length $L_5$ thereof is the shortest. The data pin P9 provides a clock signal transmission path, and the peripheral device can transmit a device data to the host or the device data can be transmitted from the host to the peripheral device along with the clock signal through the data pin P8. The host determines the type of the peripheral device according to the device data and controls the peripheral device through data transmission.

In the usage of the connector, the aggregation of the ground pin P5, the power supply pin P1, and the signal pins P2, P3, P4 has the function of connecting a USB interface and the ground pin P5, the power supply pin P1, and the signal pins P2, P3, P4 are disposed on the same surface of the connector. Wherein the power supply pin P1 provides the transmission path of the voltage source, the signal pins P2 and P3 provide the transmission path for differential signals in the USB, and the signal pin P4 is used for determining the master-slave relationship between the host and the peripheral device during signal transmission based on the voltage level thereof. The aggregation of the ground pin P5, the power supply pin P1, and the signal pins P2, P3, P4 is compatible to the pin functions of a USB interface, only the relative pin lengths are described in the present embodiment, and the respective pin function thereof should be understood by those having ordinary skill in the art, therefore will not be described herein.

Figure 2:
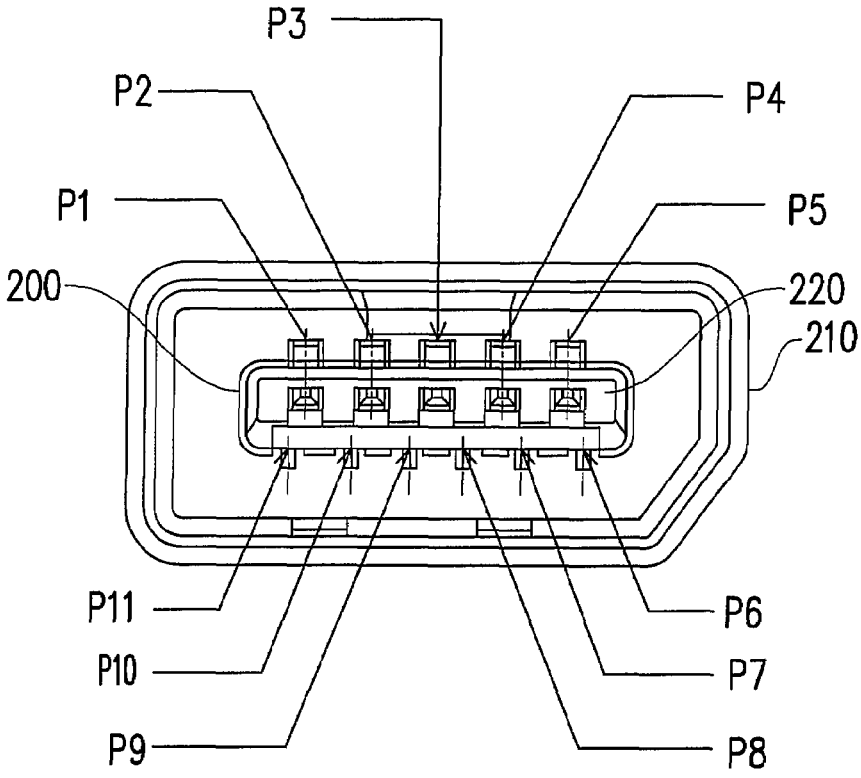
FIG. 2 is a cross-sectional view illustrating the structure of a connector according to an embodiment of the present invention.

FIG. 2 is a cross-sectional view illustrating the structure of a connector according to the present embodiment. The pins P1~P5 are disposed on the same surface of the connector 200, which is referred to as the top surface of the insulating layer 220 in the present embodiment. The pins P6~P11 are disposed on another side of the connector 200, which is referred to as the bottom surface of the insulating layer 220 in the present embodiment. The outside of the connector 200 is surrounded by a case 210. The insulating layer 220 isolates the pins P1~P5 and the pins P6~P11. The connector 200 is connected to a host through a printed circuit board. In the present embodiment, the host can be a PDA, smart cell phone, GPS device, music player, and game machine.

Next, the structure of the connector in the present embodiment will be further described with cross-sectional views. FIG. 3 is a cross-sectional view illustrating the major pins of a connector according to the present embodiment. With the signal pin P3 as example, the cross-sectional view thereof cut along line A~A' is as shown in FIG. 4A, wherein the signal pin P3 is disposed on the top surface of the insulating layer 220. With the audio pin P6 as example, the cross-sectional view thereof cut along line B~B' is as shown in FIG. 4B, wherein the ground pin P5 and the audio pin P6 are respectively disposed on the top and bottom surface of the insulating layer 220. Obviously, the ground pin P5 is closer to the opening of the case 210 than the audio pin P6, so that the ground pin P5 can first come into contact with the corresponding pin of the socket when the connector 200 is connected to the socket. With the data pin P8 as example, the cross-sectional view thereof cut along line C~C' is as shown in FIG. 4C, wherein the data pin P8 is disposed on the bottom surface of the insulating layer 220.

In the usage of the connector, the aggregation of the ground pin P5, the power supply pin P1, and the signal pins P2, P3, P4 has the function of connecting a standard USB interface 300 (shown in FIG. 5) and also the ground pin P5, the power supply pin P1, and the signal pins P2, P3, P4 are disposed on the same surface of the connector. Wherein the power supply pin P1 provides the transmission path of the voltage source, the signal pins P2 and P3 provide the transmission path for differential signals in the USB, and the signal pin P4 is used for determining the master-slave relationship between the host and the peripheral device during signal transmission based on the voltage level thereof. The aggregation of the ground pin P5, the power supply pin P1, and the signal pins P2, P3, P4 is compatible to the pin functions of a standard USB interface 300 (shown in FIG. 5), only the relative pin lengths are described in the present embodiment, and the respective pin function thereof should be understood by those having ordinary skill in the art, therefore will not be described herein.

In overview, even though only one pin combination suitable for USB and audio signal is used as example in the present embodiment for describing the present invention, the pin functions of the present invention are not limited thereto. The applications of the present invention in connectors of different pin functions or transmission interfaces can be easily understood based on the present disclosure by those having ordinary knowledge in the art, therefore will not be described herein.

According to the present invention, pins of different lengths are used for different pin functions so that signal misjudgment due to different user habit or working environment can be effectively avoided. Meanwhile, the functions of various connectors can be integrated into one single connector so that the space and design cost of hand-held electronic devices can be effectively reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector for connecting a host and a peripheral device, comprising at least:

N pin groups, the pin length of each of the pin groups being different;

wherein N is a positive integer and N is greater than or equal to 3; and the N pin groups comprises a first pin group that is a ground pin with the longest length L1 compared with other pin groups of the N pin groups.

2. The connector claimed in claim 1, wherein if N is equal to 5, the N pin groups further comprises:

a second pin group, the pin length of the second pin group being L2;

a third pin group, the pin length of the third pin group being L3;

a fourth pin group, the pin length of the fourth pin group being L4; and a fifth pin group, the pin length of the fifth pin group being L5;

wherein L1, L2, L3, L4, L5 are all positive integers and L1>L2>L3>L4>L5.

3. The connector claimed in claim 2, wherein the first pin group comprises:

a first ground pin, providing a coupling path between the peripheral device and a ground terminal cooperating with the signal transmission of the second pin group; and a second ground pin, providing another coupling path between the peripheral device and the ground terminal cooperating with the signal transmission of the fourth pin group.

4. The connector claimed in claim 3, wherein the aggregation of the second ground pin, the third pin group, and the fourth pin group has the function of connecting a USB interface.

5. The connector claimed in claim 4, wherein the third pin group comprises a power supply pin.

6. The connector claimed in claim 4, wherein the fourth pin group comprises:

two first signal pins, providing a differential signal transmission path.

7. The connector claimed in claim 6, wherein the fourth pin group further comprises:

a second signal pin, used for determining the master-slave relationship between the host and the peripheral device during signal transmission.

8. The connector claimed in claim 2, wherein the second pin group comprises:

a first audio pin, providing a left-channel audio signal transmission path;

a second audio pin, providing a right-channel audio signal transmission path; and a third audio pin, providing an audio signal transmission path for a microphone when the peripheral device is the microphone.

9. The connector claimed in claim 2, wherein the fifth pin group comprises:

a first data pin, providing a clock signal transmission path; and a second data pin, providing a device data transmission path cooperating with the clock signal;

wherein the host determines the type of the peripheral device according to the device data.

10. A connector for connecting a host and a peripheral device, comprising:

two ground pins, the pin length of each ground pin being L1;

three audio pins, the pin length of each audio pin being L2;

a power supply pin, the pin length of the power supply pin being L3;

three signal pins, the pin length of each signal pin being L4; and two data pins, the pin length of each data pin being L5;

wherein, L1, L2, L3, L4, L5 are all positive integers and L1>L2>L3>L4>L5.

11. The connector claimed in claim 10, wherein the ground pins comprise:

a first ground pin, providing a coupling path between the peripheral device and a ground terminal cooperating with the signal transmission of the audio pins; and a second ground pin, providing another coupling path between the peripheral device and the ground terminal cooperating with the signal transmission of the signal pins.

12. The connector claimed in claim 10, wherein the audio pins comprise:

a first audio pin, providing a left-channel audio signal transmission path;

a second audio pin, providing a right-channel audio signal transmission path; and a third audio pin, providing an audio signal transmission path for a microphone when the peripheral device is the microphone.

13. The connector claimed in claim 10, wherein the data pins comprise:

a first data pin, providing a clock signal transmission path; and a second data pin, providing a device data transmission path cooperating with the clock signal;

wherein the host determines the type of the peripheral device according to the device data.

14. A connector for connecting a host and a peripheral device, comprising:

an insulating layer, comprising a top surface and a bottom surface; and

N pin groups, respective1y disposed on the top surface and the bottom surface, the pin lengths of each of the pin groups being different;

wherein N is a positive integer and N is greater than or equal to 3.

15. The connector claimed in claim 14, wherein if N is equal to 5, the connector comprises:

a first pin group, the pin length of the first pin group being L1;

a second pin group, the pin length of the second pin group being L2;

a third pin group, the pin length of the third pin group being L3;

a fourth pin group, the pin length of the fourth pin group being L4; and a fifth pin group, the pin length of the fifth pin group being L5;

wherein, L1, L2, L3, L4, L5 are all positive integers and L1>L2>L3>L4>L5.

16. The connector claimed in claim 15, wherein the first pin group comprises:

a first ground pin, providing a coupling path between the peripheral device and a ground terminal cooperating with the signal transmission of the second pin group; and a second ground pin, providing another coupling path between the peripheral device and the ground terminal cooperating with the signal transmission of the fourth pin group.

17. The connector claimed in claim 16, wherein the aggregation of the second ground pin, the third pin group, and the fourth pin group has the function of connecting a USB interface, and the second ground pin, the third pin group, and the fourth pin group are all disposed on the top surface of the insulating layer.

18. The connector claimed in claim 16, wherein the first ground pin, the second pin group, and the fifth pin group are all disposed on the bottom surface of the insulating layer.

19. The connector claimed in claim 18, wherein the second pin group comprises:

a first audio pin, providing a left-channel audio signal transmission path;

a second audio pin, providing a right-channel audio signal transmission path; and a third audio pin, providing an audio signal transmission path for a microphone when the peripheral device is the microphone.

20. The connector claimed in claim 18, wherein the fifth pin group comprises:

a first data pin, providing a clock signal transmission path; and a second data pin, providing a device data transmission path cooperating with the clock signal;

wherein the host determines the type of the peripheral device according to the device data.

* * * * *